US011761298B2

(12) United States Patent
Samuel et al.

(10) Patent No.: US 11,761,298 B2
(45) Date of Patent: Sep. 19, 2023

(54) DETERMINING PARAMETERS FOR A WELLBORE PLUG AND ABANDONMENT OPERATION

(71) Applicant: Landmark Graphics Corporation, Houston, TX (US)

(72) Inventors: Robello Samuel, Cypress, TX (US); William Wade Samec, Katy, TX (US); Roddy Hebert, Houston, TX (US); Robert H. Gales, Houston, TX (US); Abbas Sami Eyuboglu, The Woodlands, TX (US)

(73) Assignee: Landmark Graphics Corporation, Houston, TX (US)

( * ) Notice: Subject to any disclaimer, the term of this patent is extended or adjusted under 35 U.S.C. 154(b) by 66 days.

(21) Appl. No.: 17/461,294

(22) Filed: Aug. 30, 2021

(65) Prior Publication Data

US 2023/0067499 A1 Mar. 2, 2023

(51) Int. Cl.

| | |
|---|---|
| ***E21B 29/00*** | (2006.01) |
| ***E21B 47/09*** | (2012.01) |
| ***E21B 33/14*** | (2006.01) |
| ***E21B 33/134*** | (2006.01) |

(52) U.S. Cl.
CPC ..... *E21B 33/14* (2013.01); *E21B 29/002* (2013.01); *E21B 33/134* (2013.01); *E21B 47/09* (2013.01)

(58) Field of Classification Search
CPC ..... E21B 47/09; E21B 29/002; E21B 29/00
See application file for complete search history.

(56) References Cited

U.S. PATENT DOCUMENTS

| | | | | |
|---|---|---|---|---|
| 5,660,239 | A * | 8/1997 | Mueller | E21B 7/04 175/57 |
| 9,822,629 | B2 | 11/2017 | Suparman et al. | |
| 10,487,640 | B2 | 11/2019 | Aniket et al. | |
| 2015/0134257 | A1* | 5/2015 | Erge | E21B 49/003 702/9 |

(Continued)

FOREIGN PATENT DOCUMENTS

| | | |
|---|---|---|
| CN | 1055033 A | 10/1991 |
| EP | 0263644 B1 | 8/1990 |

OTHER PUBLICATIONS

International Application, International Search Report and Written Opinion, PCT/US2021/048271, dated May 19, 2022, 12 pages.

*Primary Examiner* — Catherine Loikith
(74) *Attorney, Agent, or Firm* — Kilpatrick Townsend & Stockton LLP

(57) ABSTRACT

A location of a cut and an amount of force to be used in a pull operation for a plug & abandonment (P&A) operation can be determined. Measurements of at least one characteristic of fluids and solids disposed in an annulus defined between a casing and a wall of a wellbore can be received. A total fluid and solid friction force drag can be determined using hydrostatic force that is determined from the measurements. A mechanical friction force drag can be determined based on a weight of the casing. The mechanical friction force drag and the total fluid and solid friction force drag can be used to determine a friction factor. The friction factor can be used to determine a depth location at which to cut the casing and a pull force for pulling the casing from the wellbore in the P&A operation.

20 Claims, 5 Drawing Sheets

(56) References Cited

U.S. PATENT DOCUMENTS

| | | | | |
|---|---|---|---|---|
| 2016/0194947 | A1 | 7/2016 | Suparman et al. | |
| 2017/0152737 | A1 | 6/2017 | Pons | |
| 2022/0412182 | A1* | 12/2022 | Samuel | E21B 31/00 |

* cited by examiner

DETERMINING PARAMETERS FOR A WELLBORE PLUG AND ABANDONMENT OPERATION

TECHNICAL FIELD

The present disclosure relates generally to plug and abandonment operations for wellbores and, more particularly (although not necessarily exclusively), to determining parameters for such operations.

BACKGROUND

At the end of the life of a hydrocarbon well, a plug and abandonment (P&A) operation can be performed to remove equipment from the wellbore and plug the well with cement or other suitable material. The P&A operation can result in the well that is shut down to limit hydrocarbon leak into surface water or into the atmosphere.

For example, casing may be cut and recovered from a wellbore in a P&A operation. Cutting casing can involve estimating operational parameters, including the location of cutting the casing downhole in the wellbore and the force to use to remove the casing from the wellbore. Additional operational parameters may include hook load, torque, margin of overpull, and casing degradation.

Estimating the operational parameters accurately is challenging. For example, even using logged data for estimating cut location and pull force may not account for friction forces experienced during a P&A operation. As a result, casings may be cut closer to the surface than is otherwise possible.

DETAILED DESCRIPTION

Figure 1:
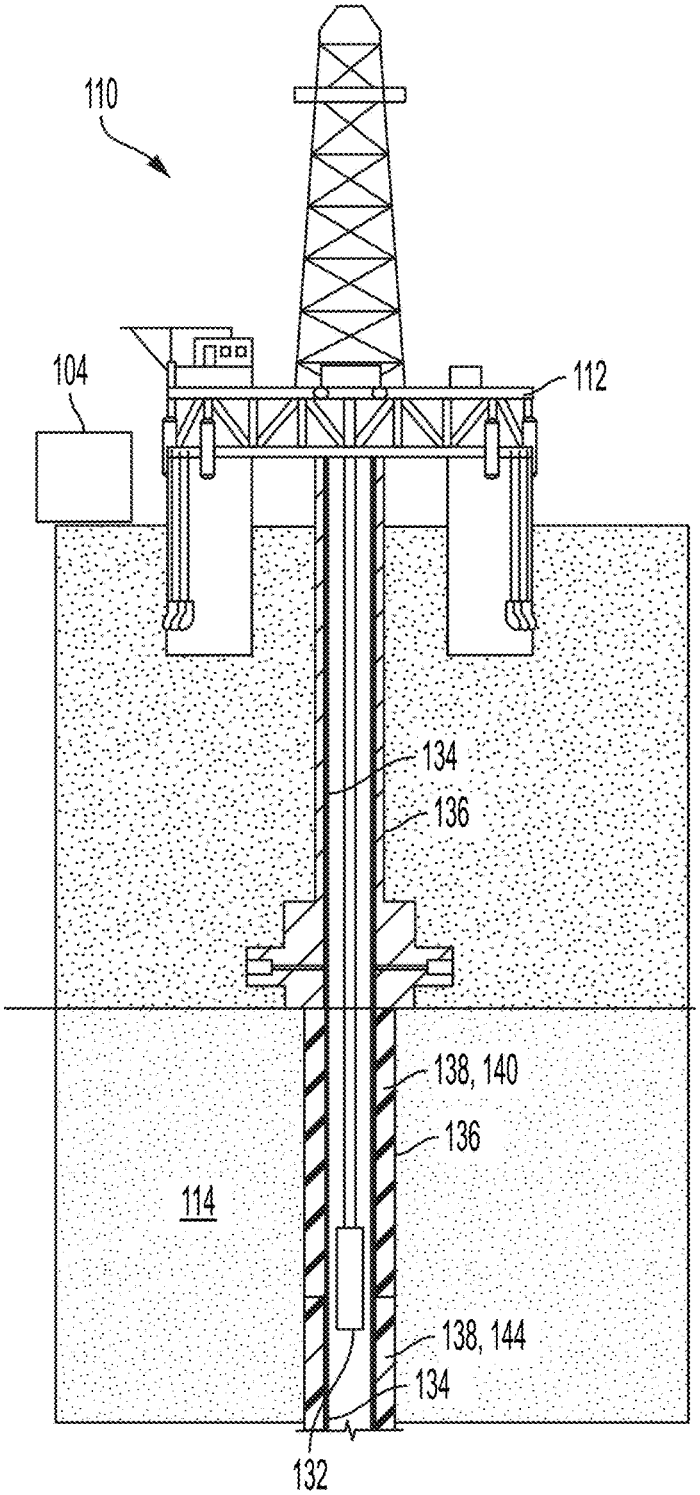
FIG. 1 is a schematic view of a wellbore in which a plug and abandonment (P&A) operation is performed on a casing disposed within a wellbore according to one example of the present disclosure.

Certain aspects and features relate to determining a depth location and pull force for a plug and abandonment (P&A) operation using a friction factor that includes total fluid and solid friction force drag and mechanical friction force drag. The depth location and the pull force can be output for use in performing the P&A operation. The depth location may be an optimal depth within a wellbore at which to cut and pull a casing. The pull force may be a calculated force to apply to the casing to pull the casing from the wellbore. The friction factor may be a value that describes different types of forces acting on the casing within the wellbore. The friction factor may indicate a level of resistance generated by the casing, which may be overcome by the pull force. The total fluid and solid friction force drag can be a resistance generated by a position of fluids and solids surrounding the casing within the wellbore. The mechanical friction force drag can be a resistance generated by a position of the casing in the wellbore under tension. The depth location and the pull force may be determined based on the friction factor. The pull force may overcome the friction factor upon reaching an equilibrium condition. The equilibrium condition may include additional forces that are used to overcome the forces included in the friction factor—thus keeping the casing from resisting the pull force during the cut and pull of the casing. Determining the pull force may include determining the additional forces that may overcome the friction factor.

Difficulty of determining the pull force for a P&A operation can lie in accurately determining or estimating content of annular materials downhole and amount of casing wear. Wellbore and casing characteristics can indicate an accurate pull force and cut location to be used for a P&A operation. A casing downhole in the wellbore may be surrounded by mud, cement, and other annular materials, which can cause resistance to the cut and pull of the casing from downhole, and may provide indication of the cut location at which to use the pull force. And, casing can degrade over time, which may provide indication of the cut location at which to use the pull force. Additionally, a casing can be cut to maximize a length of the cut casings, and maximizing the length can be challenging without accurate estimations of operational parameters. Some models for estimating pull force based only on using fluid friction forces may lead to shortcomings in accurately estimating the pull force. The models may not be effective for all types of wells, such as deviated portions of wells. For example, fluid friction forces may be maximum in a vertical well while mechanical friction forces may be maximum in a lateral section of the well. Maximum fluid friction forces in the vertical well can indicate that fluid friction forces are present in the vertical well, have an impact on pulling the casing, and thus, the models are suited to the vertical well. But, since maximum mechanical forces in the lateral section of the well can indicate that mechanical forces are present and have the impact in the lateral section of the well, the models may overlook the most impactful forces on the casing in these portions of the well. For example, the models may fail to account for Coulomb friction forces in deviated portions of the well, overestimate the values for fluid friction force, and lead to inaccurate determinations of operational parameters. Further, the models may also fail to account for the viscous condition of the wellbore fluid and may not include fluid viscous forces while including fluid shear forces. The models may also fail to account for initial force that may be high due to overcoming the static fluid friction forces prior to stabilizing the initial force when in kinetic motion. Additionally, some models for estimating a depth location at which to cut the casing may fail to account for the force from casing collars that may act as a piston in the solid sediment within the wellbore, which may lead to overestimating the depth location. Furthermore, an estimation model of the pull force may not account for a yield strength of the casing given the casing degradation.

Some examples of the present disclosure can address one or more of these challenges by estimating operational parameters in the cut and pull operation via a data-driven approach and using a mechanical friction force and total fluid and solid friction force model. The model may accurately determine the pull force and a depth location at which to cut the casing based on the mechanical friction force and the total fluid and solid friction force characteristics of fluids and solids disposed within the casing and the wellbore. The model may include the fluid viscous force and not include the fluid shear force. As a result, the model can determine a pull force that overcomes the fluid viscous force and the mechanical friction force. The mechanical friction force and total fluid and solid friction force model can lead to determining the pull force more accurately for safely removing the casing. For example, a pull force that is more accurately determined can improve the safety of the P&A operation by mitigating the impact of flowing fluids during the wellbore operation that may cause breakdown of barrier elements that prevent or limit the threat of major accidents. The model may increase accuracy of determining pull force for a wider variety of wells, including deviated portions of wells, by including the mechanical friction forces and the total fluid and solid friction forces. Additionally, the model may increase accuracy of determining the pull force and the depth location by accounting for the force of casing collars and accounting for the effect of casing wear. Hook load, torque, and margin of overpull during P&A operations can be more accurately estimated using the model. The model may also lead to determining a maximum depth location at which to cut the casing more accurately and performing the plug and abandonment operation at the depth location using the pull force. Increased accuracy of the cut depth location and pull force may increase reliability for the cut and pull in a single cut or a single trip.

In some examples, the depth location and the pull force may be determined using characteristics of fluids and solids disposed in an annulus defined between the casing and a wall of the wellbore. Other characteristics about the incline of the wellbore, the casing, and the casing collars may also be used. Sensors and ultrasonic tools may be used to measure and transmit data to a computing device about the characteristics. In some embodiments, the system may generate 3D calculations of forces for 3D well profiles using the data. The calculations may then be used in equations to determine the total fluid and solid friction force drag and the mechanical friction force drag, which may be summed together to determine the friction factor. The system can provide different friction factors for various zones of solids and liquid in the wellbore. Additionally, data may be measured for determining parameters such as hook load, torque, and casing degradation. The friction factor and any other parameters can then be used to determine the depth location and the pull force. A margin of overpull may also be determined from an estimated hook load and torque. The system may then output commands for performing the P&A operation at the depth location and using the pull force and a margin of overpull.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic view of a wellbore in which a plug and abandonment (P&A) operation is performed on a casing 134 disposed within a wellbore 136 according to one example of the present disclosure.

A well system 110 can include the wellbore 136 that is formed in a subterranean formation 114. The wellbore 136, in some examples, may be abandoned or otherwise no longer in use. The wellbore 136 can be a vertical wellbore, a horizontal wellbore, a general wellbore, an open-hole wellbore, or other suitable type of wellbore. A platform 112 may have a hoisting apparatus 126 and a derrick 128 for conveying a tool 132 through the wellbore 136 penetrating the subterranean formation 114. The tool 132 may be coupled to a conveyance 130 for conveying the tool 132. The conveyance 130 may be a wireline, slickline, coiled tubing, cable, or any other suitable conveyance for conveying the tool 132 through the wellbore. In some examples, one or more downhole tools 132 can be on the same downhole tool or string of downhole tools. Examples of tools 132 can include nuclear sensors, cement bond log (CBL) tools, ultrasonic tools, or a combination thereof. The casing 134 may be surrounded by annular materials 138 disposed in an annulus between the casing 134 and a wall of the wellbore 136. The annular materials 138 may be cement, settle solids, mud, water, hydrate, gas, or a combination thereof, and the annular materials 138 may form different solid 144 and liquid 140 zones at points along the wellbore 136. For example, the annular materials 138 may form a cement sheath below a layer of mud. The tools 132 may be used to measure characteristics (e.g., amount, location, and composition) of the annular materials 138.

Log data may be taken from the tools 132 and include the measurements of characteristics of the annular materials 138. Examples of log data from the one or more tools 132 may include CBL tool logs, well sonic logs, or other logs from the nuclear sensors or ultrasonic tools. The log data may contain percentages, compositions, and locations of annular material 138 in the wellbore, or any other suitable information about the annular content modeled by the tools 132. In some examples, one or more of the log data may be used separately or in combination to determine fluid and solid friction forces on the casing 134 within the wellbore 136. In an example, the total fluid friction forces in different portions of the casing and the wellbore can be estimated based on nuclear sensor data or well sonic logs, and shear force can be estimated based on well sonic logs (e.g., shear sonic logs). Then, based on the log data, the percentages of fluid and solid content measured at particular locations within the casing 134 and the annulus of the wellbore 136 can be used to determine fluid, solid, and shear forces pertaining to the particular location. The particular location of the annular material 138 may relate to the location of the annular material 138 relative to an inner and outer surface of the casing 134 and the wellbore 136. Additionally, the log data may further be used to determine mechanical forces on the casing and other relevant calculations in determining the friction factor of the P&A operation. For example, the log data may be used to determine a mechanical tension force on the casing, an azimuth angle, an inclination angle in the wellbore, a change in the inclination angle, and a weight of the casing. The forces and other calculations can be used as factors of the total fluid and solid friction force drag and mechanical friction force drag.

A computing device 104 can be positioned at a surface of the well system 110 for receiving the measurements of characteristics about the annular materials 138 in the wellbore 136 from tools 132. In some examples, the computing device 104 can be positioned remote from the well system 110. The computing device 104 can be communicatively coupled to the tool 132 via a wired connection, a wireless connection, a Bluetooth™ connection, or via other suitable means. The computing device 104 can then receive the data about the annular materials 138.

Figure 2:
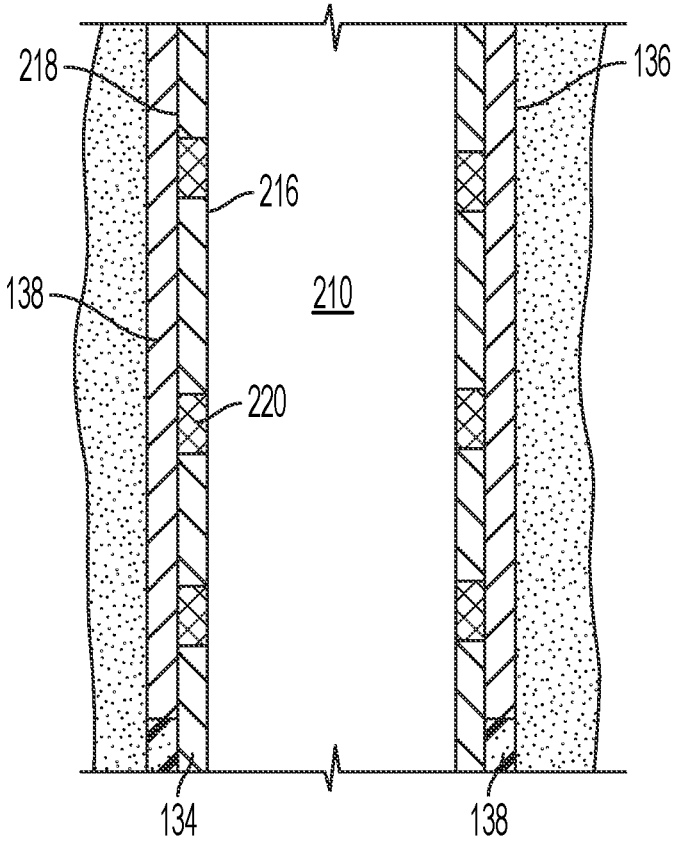
FIG. 2 is a schematic view of part of a casing with casing collars disposed within the wellbore and adjacent to wellbore fluids and solids according to one example of the present disclosure.

Now with respect to FIG. 2, FIG. 2 is a schematic view of part of a casing 134 with casing collars 220 disposed within the wellbore 136 and adjacent to wellbore fluids and solids according to one example of the present disclosure. The casing collars 220, with the casing 134, may be disposed within the annulus of the wellbore 136. While the casing 134 may be impacted by a frictional force drag in the wellbore 136 with respect to the surrounding annular materials 138 and the casing 134 itself, additionally, the casing collars 220 can provide an additional frictional force to the casing 134 that affects the friction force drag generated between the casing 134 and the wellbore 136. The casing collar 220 can couple two joints of the casing 134 for providing mechanical strength to enable a casing string, according to some embodiments. The two joints of the casing 134 can be threaded into opposite ends of the casing collar 220. The casing collars 220 can be disposed, with the casing 134, around the annular materials 138 in the wellbore 136. An outer surface 218 of the casing 134 can include outer fluids 208. An inner surface 216 of the casing 134 can include inner fluids 210 within the casing and inside an inner casing wall 216. An outer surface 218 of the casing 134 can include outer fluids 208 within the casing and outside an outer casing wall 218. Additional fluids and solids can come from the annulus defined between the casing and the wall of the wellbore 136. The fluids and solids may provide hydrostatic forces, which may impact the casing 134 and the casing collars 220. Further still, the casing collars 220 can act like a piston on the casing 134 and generate a force in a direction opposite the pull force.

In some embodiments of the present disclosure, determining the pull force can include accounting for the total friction force drag generated by the casing collars 220 in the wellbore. For example, a friction factor may be calculated for the casing collars 220. A total fluid and solid friction force drag may be calculated based on hydrostatic forces from measurements of the annular materials 138 around the casing collars 220. A mechanical friction force drag may be calculated using the total weight from the casing collars 220. Alternatively, in some examples, a total weight of the casing collars 220 may be included in the weight of the casing 134 for determining the friction factor. Additionally or alternatively, in some examples, fluid, solid, and shear forces from the casing collars 220 may be added to that of the casing 134.

Figure 3:
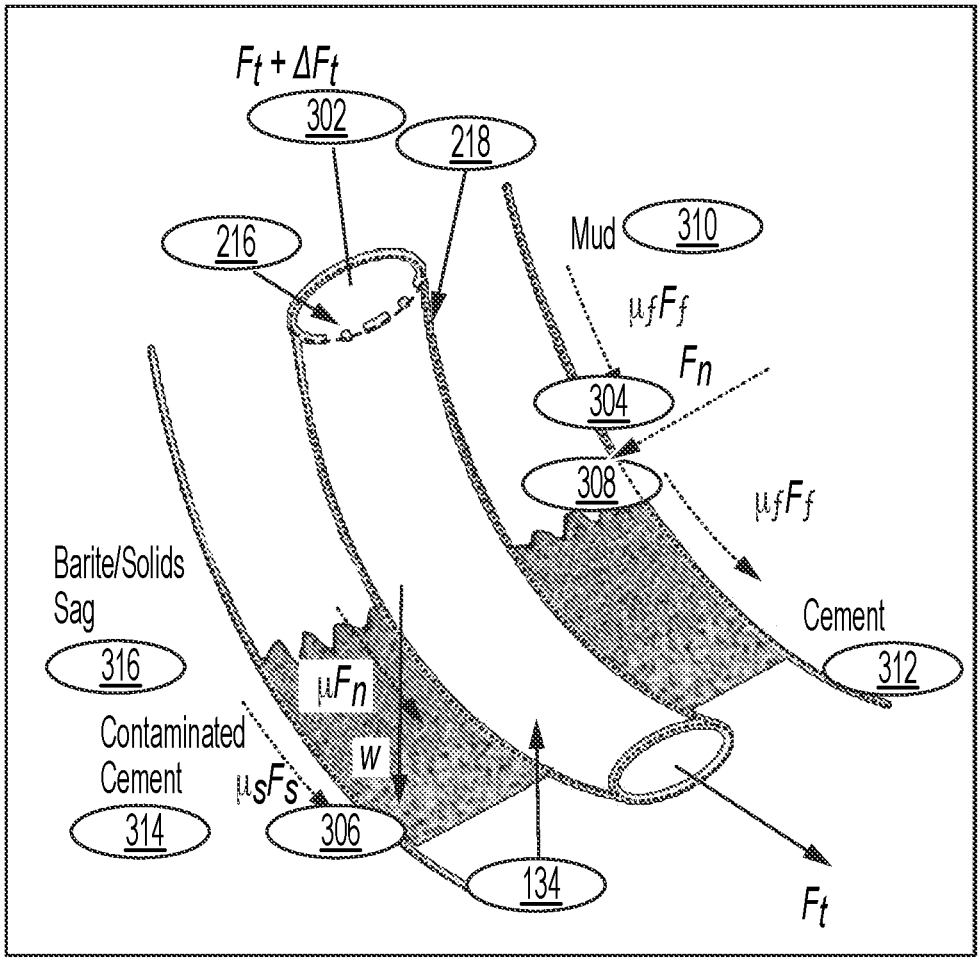
FIG. 3 is a schematic diagram of an example of friction forces that can be determined for a casing in a wellbore according to one example of the present disclosure.

FIG. 3 is a schematic diagram of an example of friction forces that can be determined for a casing 134 in a wellbore 136 according to one example of the present disclosure. Certain types of forces may include the mechanical tension force 302, Ft, a fluid friction force 304, Ff, a solid friction force 306, Fs, and a normal force 308, Fn. The mechanical tension force 302 may act on the casing under tension, and thus, may act on the casing in an upward direction from the top of the casing 134, a downward direction from the bottom of the casing 134, and a downward direction from any concave portion of the casing 134. The fluid friction force 304 may come from mud zones 310 in the wellbore, and the solid friction force 306 may come from any combination of cement 312, contaminated cement 314, or barite or solid sag zones 316. The zones 310, 312, 314, 316 of the annular material 138 may pertain to the layers in which the annular materials are positioned in the wellbore 136. In some examples, different zones may result in a different friction factor due to the annular composition of the zone of interest. The fluid friction force 304 and the solid friction force 306 may act in the downward direction from the surface of the wellbore 136. The normal force 308 may act on the casing 134 in an orthogonal direction to the direction of the fluid and solid friction forces 304, 306. The forces 302, 304, 306, 308 from the particular locations of the annular materials 138 may pertain to the factors used in an equation to compute the friction factor, as discussed herein.

The friction factor of the wellbore may be determined using a soft string method. The friction factor may be determined by summing a result of the total fluid and solid friction force drag (Equation 1) and the mechanical friction force drag (Equation 2) below. The total fluid and solid friction force drag can be determined using Equation 1, $$\Sigma_0^{dc} FF\text{in} + \Sigma_0^{dc} FF\text{out} + \Sigma_0^{dc} FS\text{out} + \Sigma_0^{dc} FS\text{hear} \quad \text{(Equation 1)},$$

where FFin is a total fluid frictional force from the fluids within the casing and inside an inner casing wall 216, determined by a function of the hydrostatic force; FFout is a total fluid frictional force from the fluids within the casing 134 and outside an outer casing wall 218; FSout is a total fluid frictional force from the fluids and solids within the annulus defined between the casing 134 and the wall of the wellbore 136; and FShear is a total shear force to overcome a bond between a cement sheath in the annulus and the casing 134. The mechanical friction force drag can be determined using Equation 2, $$[(Ft\Delta Ø \sin \alpha)2 + (Ft\Delta\alpha + W \sin \alpha)^2]^{1/2} \quad \text{(Equation 2)},$$

where Ft is a mechanical tension force on the casing 134; Ø is an azimuth angle; α is an inclination angle in the wellbore 136; Δα is a change in the inclination angle; and W is the weight of the casing 134.

In some examples, various friction factors may be determined for the various zones 310, 312, 314, 316 of solids and liquids in the wellbore 136. The model may not be able to provide the friction factors of the mechanical friction force drag for the vertical section of the wellbore 136 as the friction forces 302, 304, 306, 308 in Equations 1 and 2 are zero in the vertical section of the wellbore 136.

The friction factor may be used to determine the pull force and the depth location at which to cut the casing 134. Alternatively, or additionally, the model may have the option to automatically calculate pull forces at the surface of the wellbore 136 for a given cut depth location. Additional forces acting on the casing 134 can include frictional coefficients and changes in force, Mf, Ms, MFn, and ΔFt, as generated by the casing 134 in motion to overcome the forces included in the friction factor. As a result, subsequent analysis that utilizes the friction factor to determine the pull force may determine the additional forces that may be needed for the forces 302, 304, 306, 308 in the friction factor to be considered at equilibrium.

Figure 4:
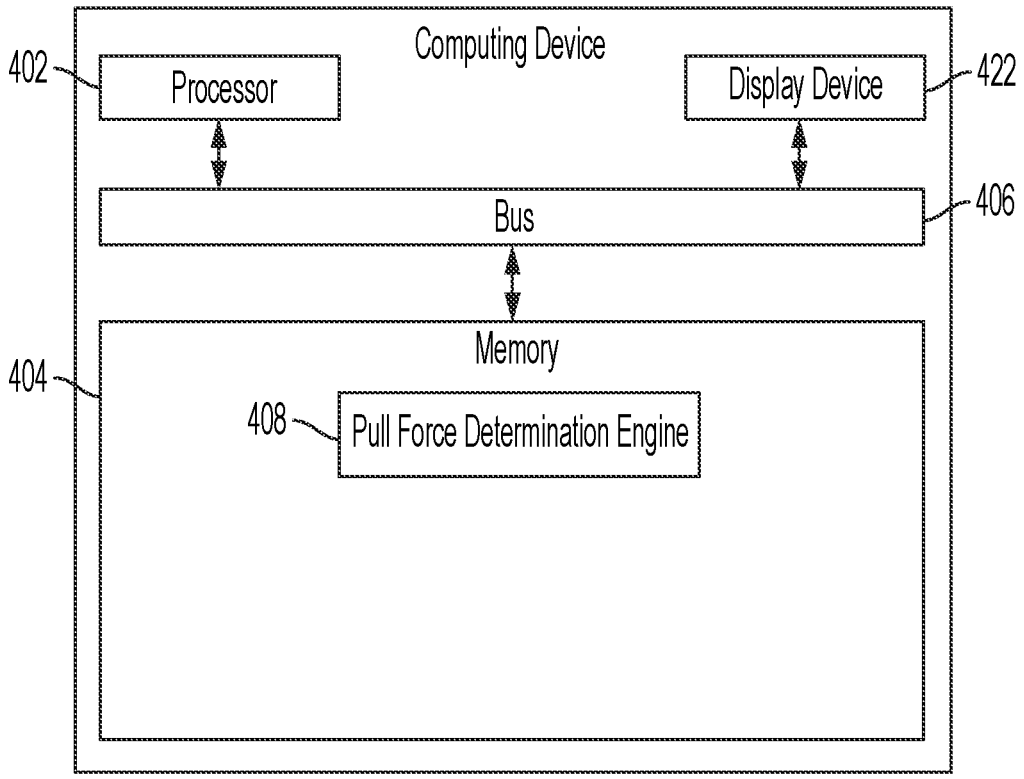
FIG. 4 is a block diagram of an example of a computing device that can be used for estimating cut location and pull force for a P&A operation according to one example of the present disclosure.

FIG. 4 is a block diagram of an example of a computing device 104 that can be used for estimating cut location and pull force for a P&A operation according to one example of the present disclosure. The components shown in FIG. 4, such as the processor 402 and memory 404, may be integrated into a single structure, such as within a single housing of the computing device 104. Alternatively, the components shown in FIG. 4 can be distributed from one another and in electrical communication with each other.

The computing device 104 can include a processor 402, a memory 404, and a bus 406. The processor 402 can execute one or more operations for determining cut depth location and pull force of a P&A operation. The processor 402 can execute instructions stored in the memory 402 to perform the operations. The processor 402 can include one processing device or multiple processing devices or cores. Non-limiting examples of the processor 402 include a Field-Programmable Gate Array ("FPGA"), an application-specific integrated circuit ("ASIC"), a microprocessor, etc.

The processor 402 can be communicatively coupled to the memory 404 via the bus 406. The non-volatile memory 404 may include any type of memory device that retains stored information when powered off. Non-limiting examples of the memory 404 may include EEPROM, flash memory, or any other type of non-volatile memory. In some examples, at least part of the memory 404 can include a medium from which the processor 402 can read instructions. A computer-readable medium can include electronic, optical, magnetic, or other storage devices capable of providing the processor 402 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

In some examples, the memory 404 may include computer program instructions. The instructions can be included in a pull force determination engine 408. The computing device 104 can execute the pull force determination engine 408 to determine the pull force and the depth location. For example, the computing device 104 may determine the friction factor and other suitable operational parameters, such as hook load, torque, margin of overpull, and other suitable parameters in response to receiving the measurements of the annular material in the wellbore from a sensor in the logging tool 132. The pull force determination engine 408 may output commands to perform the P&A operation at the depth location using the pull force and any other suitable operational parameters. In some examples, the computing device 104 can execute the pull force determination engine 408 to determine the pull force and the depth location while logging or in real time. For example, the computing device 104 may execute the pull force determination engine 408 after the time of logging and receiving measurements, or the process may occur contemporaneously at the time of performing the P&A operation. While logging, the computing device 104 may compute the relevant information to determine the pull force and the depth location. Additionally or alternatively, in real time the computing device 104 may compute the relevant information to determine the pull force and the depth location contemporaneously with performing the P&A operation.

Additionally, the computing device 104 can include a display device 422. In some examples, the display device 422 can connect to a keyboard, pointing device, display, and other computer input/output devices via the bus 406. Operational data, such as pull force, cut location, hook load, margin of overpull, and etc., can be displayed to an operator through the display device 422. The displayed operational data can be observed by the operator, or by a supervisor of the plug and abandonment operation, who can make adjustments based on the displayed values. In some examples, the plug and abandonment operation can be adjusted by the computing device 104 automatically based on the operational data.

Figure 5:
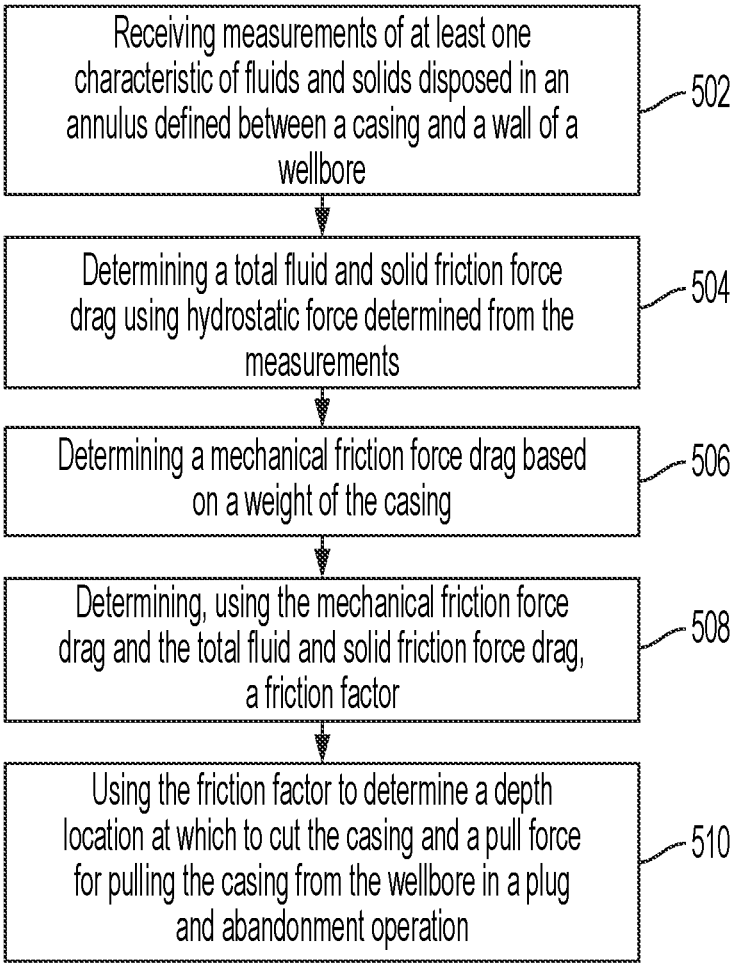
FIG. 5 is a flowchart of a process for determining a pull force using a mechanical friction force drag and total fluid and solid friction force drag for a P&A operation according to one example of the present disclosure.

FIG. 5 is a flowchart of a process for determining a pull force using a mechanical friction force drag and total fluid and solid friction force drag for a P&A operation according to one example of the present disclosure. At block 502, the computing device can receive measurements of at least one characteristic of fluids and solids disposed in an annulus defined between a casing and a wall of a wellbore. For example, the computing device may communicate with ultrasonic tools, CBL tools, and nuclear sensors and retrieve the corresponding logs. The computing device may use the log data to extract relevant data values, such as percentages, composition, and location of fluids and solids content in the wellbore, or other suitable data that may be used to determine the terms in Equations 1 and 2 (e.g., weights of the casing and weight of the casing collars). In an example, the computing device may use the location of fluid compositions located distinctly within the casing and in the annulus in the wellbore to determine the values in Equation 1. Further, relevant data may also pertain to determining a radial thickness of an inner and outer part of the casing for determining an inner and outer casing wear, or casing degradation. For example, the computing device may retrieve log data that models the casing and determine a current thickness of the casing and an original thickness of the casing.

At block 504, the computing device can determine a total fluid and solid friction force drag using hydrostatic force determined from the measurements. For example, the computing device may use the percentages of the annular content to determine the hydrostatic forces and other forces in Equation 1. The result may be stored by the computing device in memory for computing the friction factor. In some examples, the computing device may optimize calculations by implementing a framework that uses multiple microservices to output and use calculations for different needs. In some embodiments, the computing device may generate 3D calculations of forces for 3D well profiles.

At block 506, the computing device can determine a mechanical friction force drag based on a weight of the casing. For example, the computing device may use log data to determine the forces in Equation 2 and the weight of the casing and solve Equation 2. The result may also be stored by the computing device in memory for computing the friction factor. Additionally, the computing device may include instructions to determine additional forces based on the forces in Equation 2. In an example, the computing device can use the log data and determine the coefficient of the friction force, M, for friction forces Fs, Ff, Ft, and Fn, and the change in the mechanical tension force, $\Delta t$.

At block 508, the computing device can determine, using the mechanical friction force drag and the total fluid and solid friction force drag, a friction factor. For example, the computing device can determine the sum of Equation 1 and Equation 2 using the stored results of Equations 1 and 2. At block 510, the computing device can use the friction factor to determine a depth location at which to cut the casing and a pull force for pulling the casing from the wellbore in a plug and abandonment operation. In some examples, the friction factor can be included in a torque and drag calculation used in determining the pull force. The torque and drag calculation can include solving for the equilibrium condition of the total forces acting on the casing in the P&A operation. The computing device can solve for the equilibrium condition based on balancing the forces in the friction factor. For example, the computing device can determine the coefficient of the friction force M or the change in force $\Delta$. In some examples, the computing device can further determine any other suitable operational parameters, such as hook load, torque, and margin of overpull. In some examples, the computing device can determine the hook load of the drill pipe based on an air weight and a buoyancy factor of the drill pipe. In some examples, the computing device can determine the margin of overpull, or force used to pull the casing from downhole, based on a yield strength of the drill pipe, the hook load, and the torque. In some examples, the computing device may use log data for determining minimum operating pressure (MOP), yield limits of the drill pipe, and failure analysis of the drill pipe. The computing device may use a platform (e.g., DS365.ai) to create automated work flows for determining operational parameters with no code or low code use.

The computing device may then determine the pull force, or total force, that is sufficient to overcome the friction factor and additional forces in the P&A operation. In some examples, the pull force may be separate from the margin of overpull. For example, the friction factor may be mapped to an amount of force, which may be the pull force. In some examples, the pull force may include the margin of overpull. For example, the friction factor may be mapped to an amount of force, and the computing device may add the force and additional forces to the margin of overpull to determine the pull force. The computing device may then determine the depth location at which to perform the P&A operation based on the pull force. For example, the computing device may map the depth location to the pull force. In some examples, the computing device may automatically calculate pull forces at the surface of the wellbore for a given cut depth location. For example, the computing device may solve for the friction factor using values at the depth location of the wellbore under equilibrium and determine the pull force.

In some examples, determining the pull force can include determining a degradation of the casing by estimating casing wear using the thickness of the casing. In an example, the computing device can run well sonic logs to determine the thickness of the casing. The thickness of the casing can be compared to an original thickness of the casing. In some examples, a casing degradation factor can be applied to the calculated pull force. The casing degradation can be a value (e.g., ratio) that indicates how much the strength of the casing has degraded such that casing degradation may be factored into the pull force. In some examples, the ratio of the original thickness to the current thickness can be taken to linearly describe the effect of the casing wear on the pull force, and the estimated casing wear may be mapped to the pull force that is in accordance with the degradation of the casing.

In some aspects, a system, method, and apparatus for determining a depth location and pull force for a P&A operation using total fluid and solid friction force drag and mechanical friction force drag are provided according to one or more of the following examples:

Example 1 is a method comprising: receiving measurements of at least one characteristic of fluids and solids disposed in an annulus defined between a casing and a wall of a wellbore; determining a total fluid and solid friction force drag using hydrostatic force determined from the measurements; determining a mechanical friction force drag based on a weight of the casing; determining, using the mechanical friction force drag and the total fluid and solid friction force drag, a friction factor; and using the friction factor to determine a depth location at which to cut the casing and a pull force for pulling the casing from the wellbore in a plug and abandonment operation.

Example 2 is the method of example 1, further comprising outputting commands for performing the plug and abandonment operation at the depth location and using the pull force.

Example 3 is the method of examples 1-2, wherein determining the total fluid and solid friction force drag includes using Equation 1: $\Sigma_0^{dc}FFin+\Sigma_0^{dc}FFout+\Sigma_0^{dc}FSout+\Sigma_0^{dc}FShear$ (Equation 1), where: FFin is a total fluid frictional force from the fluids within the casing and inside an inner casing wall, determined by a function of the hydrostatic force; FFout is a total fluid frictional force from the fluids within the casing and outside an outer casing wall; FSout is a total fluid frictional force from the fluids and solids within the annulus defined between the casing and the wall of the wellbore; and FShear is a total shear force to overcome a bond between a cement sheath in the annulus and the casing; wherein determining the mechanical friction force drag includes using Equation 2: $[(Ft\Delta Ø \sin \alpha)2+(Ft\Delta\alpha+W \sin \alpha)^2]^{1/2}$ (Equation 2), where: Ft is a mechanical tension force on the casing; Ø is an azimuth angle; $\alpha$ is an inclination angle in the wellbore; $\Delta\alpha$ is a change in the inclination angle; and W is the weight of the casing; and wherein determining the friction factor comprises summing a result from Equation 1 and a result from Equation 2.

Example 4 is the method of examples 1-3, wherein determining the mechanical friction force drag includes using additional frictional forces from casing collars on the casing and a total weight of the casing collars.

Example 5 is the method of examples 1-4, wherein using the friction factor to determine the pull force includes determining an equilibrium condition between a total of frictional forces acting on the casing and a total force needed to overcome the total of frictional forces.

Example 6 is the method of examples 1-5, further comprising: determining a margin of overpull based on an estimated hook load and torque.

Example 7 is the method of examples 1-6, wherein using the friction factor to determine the pull force includes determining a degradation of casing strength using an estimated thickness of the casing, wherein the degradation of the casing strength is used to determine the pull force, and the pull force is within the casing strength.

Example 8 is a system comprising: a processing device; and a memory device that includes instructions executable by the processing device for causing the processing device to perform operations comprising: receiving measurements of at least one characteristic of fluids and solids disposed in an annulus defined between a casing and a wall of a wellbore; determining a total fluid and solid friction force drag using hydrostatic force determined from the measurements; determining a mechanical friction force drag based on a weight of the casing; determining, using the mechanical friction force drag and the total fluid and solid friction force drag, a friction factor; and using the friction factor to determine a depth location at which to cut the casing and a pull force for pulling the casing from the wellbore in a plug and abandonment operation.

Example 9 is the system of example 8, wherein the operations further comprise: outputting commands for performing the plug and abandonment operation at the depth location and using the pull force.

Example 10 is the system of examples 8-9, wherein the operation of determining the total fluid and solid friction force drag includes using Equation 1: $\Sigma_0^{dc}FFin+\Sigma_0^{dc}FFout+\Sigma_0^{dc}FSout+\Sigma_0^{dc}FShear$ (Equation 1), where: FFin is a total fluid frictional force from the fluids within the casing and inside an inner casing wall, determined by a function of the hydrostatic force; FFout is a total fluid frictional force from the fluids within the casing and outside an outer casing wall; FSout is a total fluid frictional force from the fluids and solids within the annulus defined between the casing and the wall of the wellbore; and FShear is a total shear force to overcome a bond between a cement sheath in the annulus and the casing; wherein determining the mechanical friction force drag includes using Equation 2: $[(Ft\Delta Ø \sin \alpha)2+(Ft\Delta\alpha+W \sin \alpha)^2]^{1/2}$ (Equation 2), where: Ft is a mechanical tension force on the casing; Ø is an azimuth angle; $\alpha$ is an inclination angle in the wellbore; $\Delta\alpha$ is a change in the inclination angle; and W is the weight of the casing; and wherein determining the friction factor comprises summing a result from Equation 1 and a result from Equation 2.

Example 11 is the system of examples 8-10, wherein the operation of determining the mechanical friction force drag includes using additional frictional forces from casing collars on the casing and a total weight of the casing collars.

Example 12 is the system of examples 8-11, wherein the operation of using the friction factor to determine the pull force includes determining an equilibrium condition between a total of frictional forces acting on the casing and a total force needed to overcome the total of frictional forces.

Example 13 is the system of examples 8-12, wherein the operations further comprise: determining a margin of overpull based on an estimated hook load and torque.

Example 14 is the system of examples 8-13, wherein the operation of using the friction factor to determine the pull force includes determining a degradation of casing strength using an estimated thickness of the casing, wherein the degradation of the casing strength is used to determine the pull force, and the pull force is within the casing strength.

Example 15 is a non-transitory computer-readable medium comprising instructions that are executable by a processing device for causing the processing device to perform operations comprising: receiving measurements of at least one characteristic of fluids and solids disposed in an annulus defined between a casing and a wall of a wellbore; determining a total fluid and solid friction force drag using hydrostatic force determined from the measurements; determining a mechanical friction force drag based on a weight of the casing; determining, using the mechanical friction force drag and the total fluid and solid friction force drag, a friction factor; and using the friction factor to determine a depth location at which to cut the casing and a pull force for pulling the casing from the wellbore in a plug and abandonment operation.

Example 16 is the non-transitory computer-readable medium of example 15, wherein the operations further comprise: outputting commands for performing the plug and abandonment operation at the depth location and using the pull force.

Example 17 is the non-transitory computer-readable medium of examples 15-16, wherein the operation of determining the total fluid and solid friction force drag includes using Equation 1: $\Sigma_0^{dc}FFin+\Sigma_0^{dc}FFout+\Sigma_0^{dc}FSout+\Sigma_0^{dc}FShear$ (Equation 1), where: FFin is a total fluid frictional force from the fluids within the casing and inside an inner casing wall, determined by a function of the hydrostatic force; FFout is a total fluid frictional force from the fluids within the casing and outside an outer casing wall; FSout is a total fluid frictional force from the fluids and solids within the annulus defined between the casing and the wall of the wellbore; and FShear is a total shear force to overcome a bond between a cement sheath in the annulus and the casing; wherein determining the mechanical friction force drag includes using Equation 2: $[(Ft\Delta Ø \sin \alpha)2+(Ft\Delta\alpha+W \sin \alpha)^2]^{1/2}$, where: Ft is a mechanical tension force on the casing; Ø is an azimuth angle; $\alpha$ is an inclination angle in the wellbore; $\Delta\alpha$ is a change in the inclination angle; and W is the weight of the casing; and wherein determining the friction factor comprises summing a result from Equation 1 and a result from Equation 2.

Example 18 is the non-transitory computer-readable medium of examples 15-17, wherein the operation of determining the mechanical friction force drag includes using additional frictional forces from casing collars on the casing and a total weight of the casing collars.

Example 19 is the non-transitory computer-readable medium of examples 15-18, wherein the operation of using the friction factor to determine the pull force includes determining an equilibrium condition between a total of frictional forces acting on the casing and a total force needed to overcome the total of frictional forces.

Example 20 is the non-transitory computer-readable medium of examples 15-19, wherein the operations further comprise: determining a margin of overpull based on an estimated hook load and torque.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method comprising:

receiving measurements of at least one characteristic of fluids and solids disposed in an annulus defined between a casing and a wall of a wellbore;

determining a total fluid and solid friction force drag using hydrostatic force determined from the measurements;

determining a mechanical friction force drag based on a weight of the casing;

determining, using the mechanical friction force drag and the total fluid and solid friction force drag, a friction factor;

using the friction factor to determine a depth location at which to cut the casing and a pull force for pulling the casing from the wellbore in a plug and abandonment operation; and performing the plug and abandonment operation using the depth location and the pull force.

2. The method of claim 1, further comprising outputting commands for performing the plug and abandonment operation at the depth location and using the pull force.

3. The method of claim 1, wherein determining the total fluid and solid friction force drag includes using Equation 1:

$$\Sigma_0^{dc}FFin+\Sigma_0^{dc}FFout+\Sigma_0^{dc}FSout+\Sigma_0^{dc}FShear \quad \text{(Equation 1)},$$

where:

FFin is a total fluid frictional force from the fluids within the casing and inside an inner casing wall, determined by a function of the hydrostatic force;

FFout is a total fluid frictional force from the fluids within the casing and outside an outer casing wall;

FSout is a total fluid frictional force from the fluids and solids within the annulus defined between the casing and the wall of the wellbore; and FShear is a total shear force to overcome a bond between a cement sheath in the annulus and the casing;

wherein determining the mechanical friction force drag includes using Equation 2:

$$[(Ft\Delta Ø \sin \alpha)2+(Ft\Delta\alpha+W \sin \alpha)^2]^{1/2} \quad \text{(Equation 2)},$$

where:

F t is a mechanical tension force on the casing;

Ø is an azimuth angle;

α is an inclination angle in the wellbore;

Δα is a change in the inclination angle; and

W is the weight of the casing; and wherein determining the friction factor comprises summing a result from Equation 1 and a result from Equation 2.

4. The method of claim 1, wherein determining the mechanical friction force drag includes using additional frictional forces from casing collars on the casing and a total weight of the casing collars.

5. The method of claim 1, wherein using the friction factor to determine the pull force includes determining an equilibrium condition between a total of frictional forces acting on the casing and a total force needed to overcome the total of frictional forces.

6. The method of claim 1, further comprising:

determining a margin of overpull based on an estimated hook load and torque.

7. The method of claim 1, wherein using the friction factor to determine the pull force includes determining a degradation of casing strength using an estimated thickness of the casing, wherein the degradation of the casing strength is used to determine the pull force, and the pull force is within the casing strength.

8. A system comprising:

a processing device; and a memory device that includes instructions executable by the processing device for causing the processing device to perform operations comprising:

receiving measurements of at least one characteristic of fluids and solids disposed in an annulus defined between a casing and a wall of a wellbore;

determining a total fluid and solid friction force drag using hydrostatic force determined from the measurements;

determining a mechanical friction force drag based on a weight of the casing;

determining, using the mechanical friction force drag and the total fluid and solid friction force drag, a friction factor; and using the friction factor to determine a depth location at which to cut the casing and a pull force for pulling the casing from the wellbore in a plug and abandonment operation.

9. The system of claim 8, wherein the operations further comprise:

outputting commands for performing the plug and abandonment operation at the depth location and using the pull force.

10. The system of claim 8, wherein the operation of determining the total fluid and solid friction force drag includes using Equation 1:

$$\Sigma_0^{dc} FF\text{in} + \Sigma_0^{dc} FF\text{out} + \Sigma_0^{dc} FS\text{out} + \Sigma_0^{dc} FS\text{hear} \quad \text{(Equation 1)},$$

where:

FFin is a total fluid frictional force from the fluids within the casing and inside an inner casing wall, determined by a function of the hydrostatic force;

FFout is a total fluid frictional force from the fluids within the casing and outside an outer casing wall;

FSout is a total fluid frictional force from the fluids and solids within the annulus defined between the casing and the wall of the wellbore; and FShear is a total shear force to overcome a bond between a cement sheath in the annulus and the casing;

wherein determining the mechanical friction force drag includes using Equation 2:

$$[(Ft\Delta Ø \sin \alpha)2+(Ft\Delta\alpha+W \sin \alpha)^2]^{1/2} \quad \text{(Equation 2)},$$

where:

F t is a mechanical tension force on the casing;

Ø is an azimuth angle;

α is an inclination angle in the wellbore;

Δα is a change in the inclination angle; and

W is the weight of the casing; and wherein determining the friction factor comprises summing a result from Equation 1 and a result from Equation 2.

11. The system of claim 8, wherein the operation of determining the mechanical friction force drag includes using additional frictional forces from casing collars on the casing and a total weight of the casing collars.

12. The system of claim 8, wherein the operation of using the friction factor to determine the pull force includes determining an equilibrium condition between a total of frictional forces acting on the casing and a total force needed to overcome the total of frictional forces.

13. The system of claim 8, wherein the operations further comprise:

determining a margin of overpull based on an estimated hook load and torque.

14. The system of claim 8, wherein the operation of using the friction factor to determine the pull force includes determining a degradation of casing strength using an estimated thickness of the casing, wherein the degradation of the casing strength is used to determine the pull force, and the pull force is within the casing strength.

15. An apparatus comprising:

a non-transitory computer-readable medium comprising instructions that are executable by a processing device for causing the processing device to perform operations comprising:

receiving measurements of at least one characteristic of fluids and solids disposed in an annulus defined between a casing and a wall of a wellbore;

determining a total fluid and solid friction force drag using hydrostatic force determined from the measurements;

determining a mechanical friction force drag based on a weight of the casing;

determining, using the mechanical friction force drag and the total fluid and solid friction force drag, a friction factor; and using the friction factor to determine a depth location at which to cut the casing and a pull force for pulling the casing from the wellbore in a plug and abandonment operation.

16. The apparatus of claim 15, wherein the operations further comprise:

outputting commands for performing the plug and abandonment operation at the depth location and using the pull force.

17. The apparatus of claim 15, wherein the operation of determining the total fluid and solid friction force drag includes using Equation 1:

$$\Sigma_0^{dc} FF\text{in} + \Sigma_0^{dc} FF\text{out} + \Sigma_0^{dc} FS\text{out} + \Sigma_0^{dc} FS\text{hear} \quad \text{(Equation 1)},$$

where:

FFin is a total fluid frictional force from the fluids within the casing and inside an inner casing wall, determined by a function of the hydrostatic force;

FFout is a total fluid frictional force from the fluids within the casing and outside an outer casing wall;

FSout is a total fluid frictional force from the fluids and solids within the annulus defined between the casing and the wall of the wellbore; and FShear is a total shear force to overcome a bond between a cement sheath in the annulus and the casing;

wherein determining the mechanical friction force drag includes using Equation 2:

$$[(Ft\Delta Ø \sin \alpha)2+(Ft\Delta\alpha+W \sin \alpha)^2]^{1/2} \quad \text{(Equation 2)},$$

where:

F t is a mechanical tension force on the casing;

Ø is an azimuth angle;

$\alpha$ is an inclination angle in the wellbore;

$\Delta\alpha$ is a change in the inclination angle; and

W is the weight of the casing; and wherein determining the friction factor comprises summing a result from Equation 1 and a result from Equation 2.

18. The apparatus of claim 15, wherein the operation of determining the mechanical friction force drag includes using additional frictional forces from casing collars on the casing and a total weight of the casing collars.

19. The apparatus of claim 15, wherein the operation of using the friction factor to determine the pull force includes determining an equilibrium condition between a total of frictional forces acting on the casing and a total force needed to overcome the total of frictional forces.

20. The apparatus of claim 15, wherein the operations further comprise:

determining a margin of overpull based on an estimated hook load and torque.

* * * * *